United States Patent [19]

Schmidt et al.

[11] Patent Number: 4,574,556

[45] Date of Patent: Mar. 11, 1986

[54] LABEL INSERTING APPARATUS

[75] Inventors: Ludwig Schmidt, Whitehall; Richard K. Hughes, Jr., Montague; Charles A. Nordlund, Whitehall, all of Mich.

[73] Assignee: International Master Products Corporation, Montague, Mich.

[21] Appl. No.: 503,566

[22] Filed: Jun. 13, 1983

[51] Int. Cl.[4] ..... B27F 7/02

[52] U.S. Cl. ..... 53/69; 53/202; 53/236; 53/247; 227/7

[58] Field of Search ..... 53/237, 202, 247, 249, 53/236, 474, 67, 69, 505; 227/7, 152; 493/91

[56] References Cited

U.S. PATENT DOCUMENTS

| | | | |
|---|---|---|---|
| 2,733,439 | 2/1956 | Pikal | 1/1 |
| 2,929,340 | 3/1960 | Töpfer | 107/8 |
| 3,330,058 | 7/1967 | Lefever | 40/25 |
| 3,442,430 | 5/1969 | Ackerman et al. | 227/2 |
| 3,479,734 | 11/1969 | Groat | 227/7 |
| 3,508,315 | 4/1970 | Hoffken | 227/99 |
| 3,514,028 | 5/1970 | Kowalczyk | 227/99 |
| 3,580,456 | 5/1971 | Zueger et al. | 227/100 |
| 3,596,574 | 8/1971 | Kozlowski et al. | 493/91 X |
| 3,780,627 | 12/1973 | Roda | 493/91 |
| 4,039,111 | 8/1977 | Rogers | 227/152 X |
| 4,151,944 | 5/1979 | Picton | 227/120 |
| 4,176,448 | 12/1979 | Zahn et al. | 29/626 |
| 4,182,474 | 1/1980 | Sato | 227/99 |
| 4,253,598 | 3/1981 | Haytayan | 227/119 |
| 4,285,456 | 8/1981 | Sheng-Wei | 227/147 |

*Primary Examiner*—James F. Coan

*Attorney, Agent, or Firm*—John A. Waters

[57] ABSTRACT

Label inserting apparatus for automatically inserting identification labels in plant containers or the like comprises a conveying track for conveying containers on a predetermined path; a horizontal label storage magazine positioned above the path for holding the labels in a horizontal stack wherein all labels except the outermost label in the stack are constrained from downward movement; an insertion mechanism mounted transversely to the outer end of the storage magazine and having a vertically reciprocable slide member abutting the outermost label in the stack, the slide having a gripping means for gripping the outermost label only and driving it downwardly into the plant container; and control means for causing labels to be inserted in each plant container. The gripping means may be a projection on the slide that engages the label and also can include a vacuum device.

12 Claims, 14 Drawing Figures

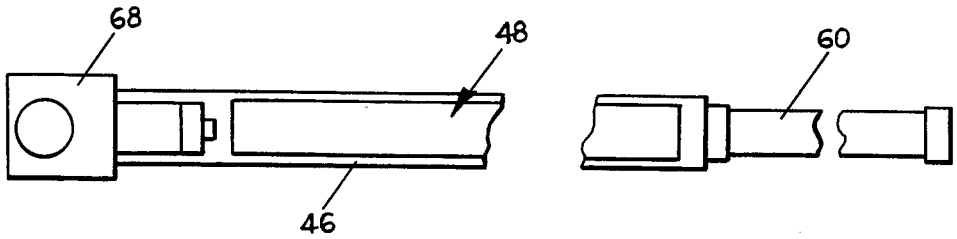
FIG. 5
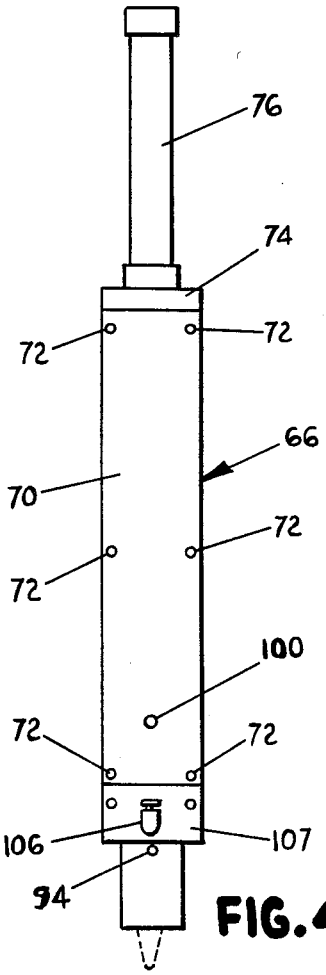
FIG. 4
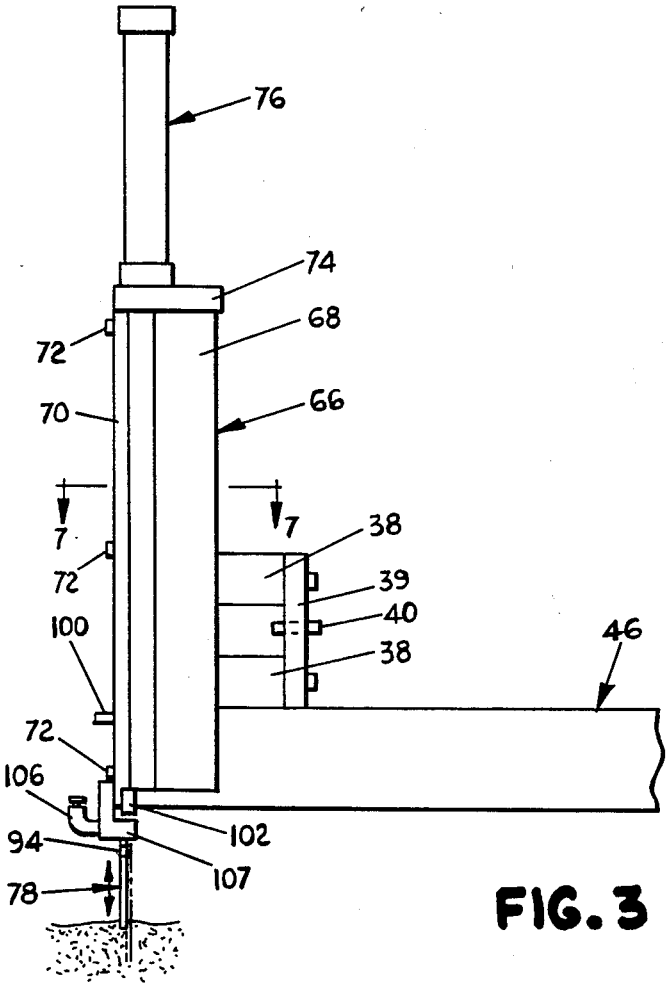
FIG. 3
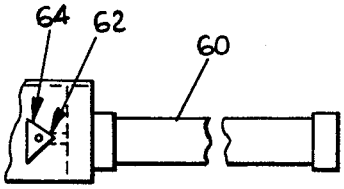

LABEL INSERTING APPARATUS

BACKGROUND OF THE INVENTION

The present invention relates to label inserting apparatus for automatically inserting identification labels formed of a flexible sheet material into plant containers.

Identification labels are widely used in the nursery industry in order to identify plants contained in a plant flat or other such plant container. Typically, an identification label is formed of thin flexible sheet plastic and comprises a tapered stem that fits in the soil and an information portion on the top of the label. The information portion can include a picture of the plant and instructions for watering and light or the like. Sometimes labels are reinforced for strength by forming a slight crease in the stem. Typical labels might vary from 10 to 30 thousands of an inch in thickness and might be formed of polystyrene or the like.

Insertion of labels into plant containers typically is a tedious job performed by hand. While many other aspects of the production of flats or market packs of plants have been automated, hand insertion of labels is still prevalent.

One of the objects of the present invention is to provide an automatic label inserting mechanism for inserting identification labels into plant containers that is reasonable in cost and effective in operation.

Some of the particular problems faced in the horticultural industry are the variability in thickness of the individual plant labels, a result of fluctuations in the plastic sheet extrusion process; the presence of "hairs" or "feathers" of plastic left by the process of die-cutting labels from the sheet material; ragged corners and nicks left by the cutting process; the thinness and flexibility of the labels themselves; and contamination caused by using the apparatus in proximity to soil contained in plant containers. In addition, the creases added to the labels to provide rigidity disrupt the uniform flat surface of the labels and make them more difficult to handle.

SUMMARY OF THE INVENTION

In accordance with the present invention, label inserting apparatus for automatically inserting identification labels formed of a flexible sheet material into plant containers comprises a conveying mechanism for carrying a series of plant containers along a predetermined path; a storage mechanism for holding a plurality of labels in a stack above the path in position to be inserted into the containers as they pass under the labels; and an insertion mechanism for inserting labels one at a time into the plant containers by gripping the outermost label in the stack and sliding the label out of the stack and into the plant container adjacent the label; and a control mechanism for causing the label to be inserted in each plant container as it passes under the insertion mechanism.

In the present invention, the storage mechanism comprises a horizontal storage magazine that holds the labels in a horizontal stack, with the magazine restraining downward movement of all labels except the outermost label on the stack and the labels being resiliently biased toward the outermost label. The insertion mechanism is mounted transversly at the outermost end of the storage mechanism and includes a slide member mounted for reciprocal movement in an up and down direction between a retracted position and an extended position. The slide member abuts the outermost end of the stack of labels and includes a gripping means for holding the outermost label to the surface of the slide and moving the label downwardly into contact with the plant container soil when the slide is extended.

Desirably, the slide comprises an indented portion that accommodates the outermost label, with a ridge at the top of the indentation engaging and driving the label downwardly. In addition, a vacuum means holds the label to the slide member until the slide member has extended to the point where the label is inserted in the plant container. A beveled surface on the ridge urges the label against the slide as the slide is extended. A stripper bar positioned adjacent the slide above the label prevents the labels from moving upwardly as the slide is retracted.

Another feature of the present invention is an air jet cleaning means for removing any soil or the like picked up by the slide member when it is extended into contact with the plant container soil.

In label inserting applications wherein plants are contained in a plant flat or market pack containing a number of rows and columns of plant receptacles in a single tray, a plurality of label inserting units can be employed for the multiple columns, and limit switch means can be arranged to cause these units to insert a label in each row of plant receptacles in the tray as they pass underneath the label inserting units.

These and other features and advantages of the present invention are described below and shown in the appended drawings.

BRIEF DESCRIPTION OF THE DRAWINGS

FIG. 3 is a side elevational view of the label inserting mechanism of the present invention.

FIG. 4 is a end elevational view of the label inserting mechanism of the present invention.

FIG. 5 is a top view of the label inserting mechanism of the present invention.

DETAILED DESCRIPTION OF THE PREFERRED EMBODIMENTS

Figure 13:
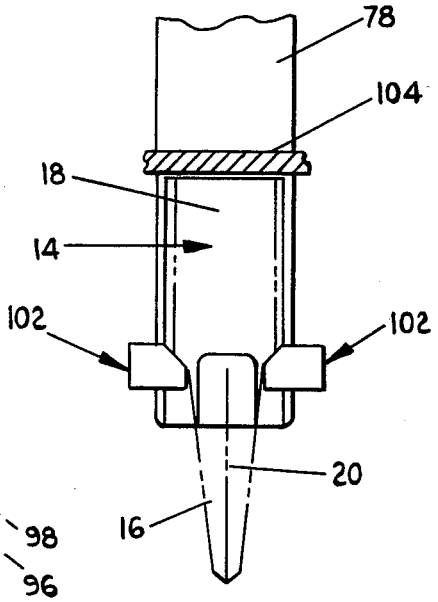
FIG. 13 is a view showing the face of the slide member as it engages the outermost label in the storage magazine, and showing the stripper bar and gate mechanism for limiting movement of identification labels to one at a time movement in a downward direction.
Figure 12:
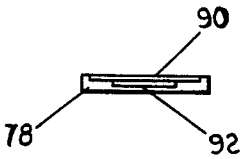
FIG. 12 is an end view of the slide member of the present invention.
Figure 14:
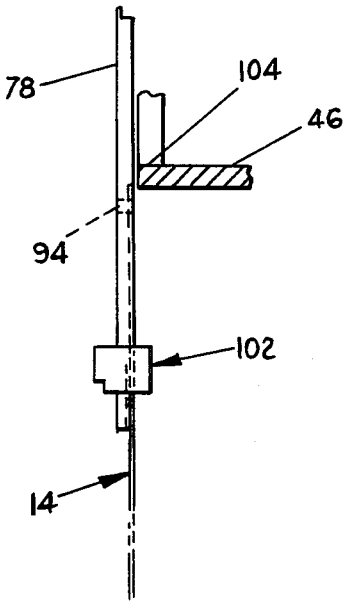
FIG. 14 is an edge view of the mechanism shown in FIG. 13.

Referring now to the drawings, label inserting apparatus 10 constructed in accordance with the present invention is shown in position to insert labels in plant compartments in planting tray 12. A typical label 14 is shown in FIGS. 13 and 14. Typically, such a label is formed of polystyrene or similar flexible plastic and comprises a tapered stem 16 and a generally rectangular head portion 18 upon which horticultural information is printed. The stem can have a crease 20 in order to improve the rigidity of the stem. Typically, these labels are die-cut from extruded sheets of plastic.

While the present invention is described in connection with apparatus for inserting plastic labels into plant containers, it is contemplated that the present invention could adventageously be employed for inserting like labels in similar situations in other applications.

Referring back to FIG. 1, label inserting apparatus 10 is mounted on upright support members 20 to a conveyor table 24 having supporting legs 26. Conveyor table 24 is positioned adjacent a section of belt conveyor 25 or the like and comprises slide rails 28 positioned under trays 12 and side rails 30 positioned on each side of the conveyor table to constrain sideways movement of the trays. The trays are pushed on the conveyor table by a moving conveyor and are moved in this manner underneath the label inserting apparatus.

Figure 1:
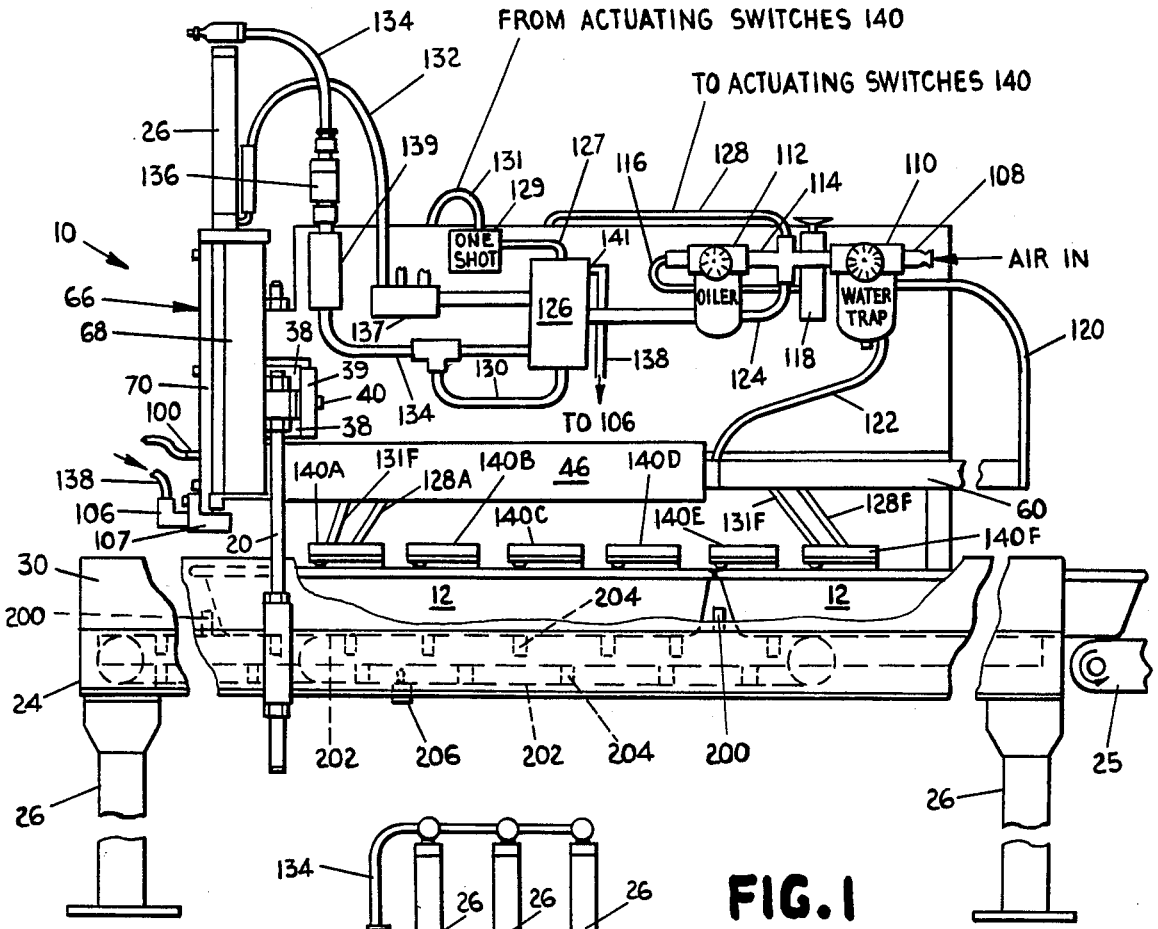
FIG. 1 is a partially broken side elevational view of a label inserting apparatus according to the present invention.
Figure 2:
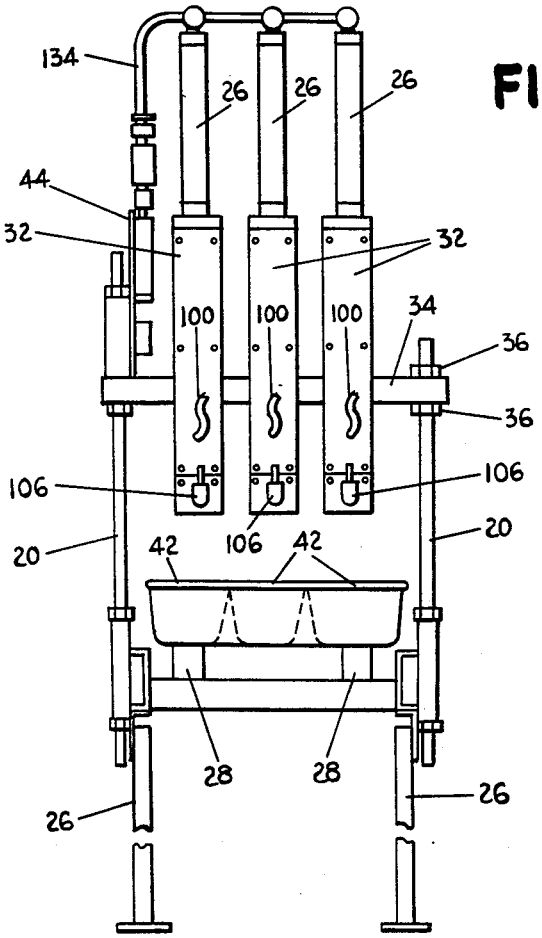
FIG. 2 is an end elevational view of the present invention.

Label inserting apparatus 10 in the FIG. 1 and FIG. 2 embodiments comprises three separate label inserting units 32, each of which is mounted on a crossbar 34 attached to the upper ends of support struts 20 by nuts 36 or the like. The label inserting units are attached to cross member 34 between legs 38 extending from each inserting unit, with a cover plate 39 fitting over and being attached to the ends of the legs. A set screw 40 extends through the cover plate and engages the cross-member and holds the label inserting units in their desired lateral positions on the cross member. Each label inserting unit is mounted above a plant cavity 42 in the planting tray. As illustrated, planting tray 12 has three columns of plant cavities, with six rows of cavities being formed in the planting tray.

The apparatus is driven pnuematically by conventional pnuematic components mounted on a mounting board 44 vertically positioned on one side of the conveyor table.

Figure 6:
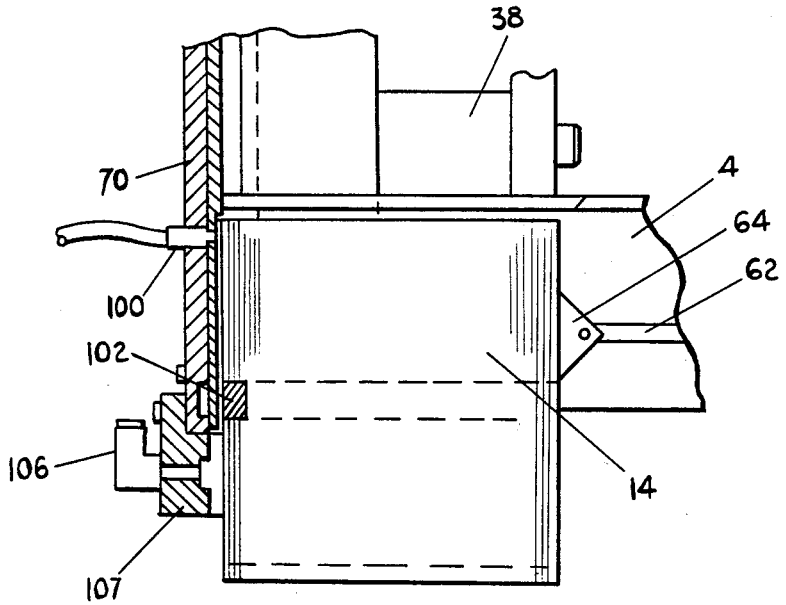
FIG. 6 is a sectional side elevational view of a portion of the label inserting apparatus of the present invention.
Figure 7:
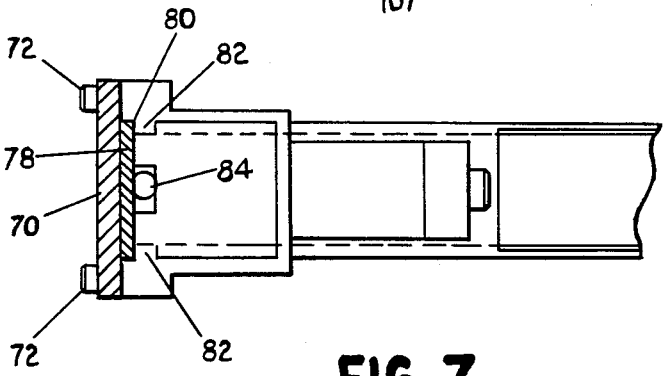
FIG. 7 is a sectional view taken along lines 7—7 of FIG. 3.
Figure 9:
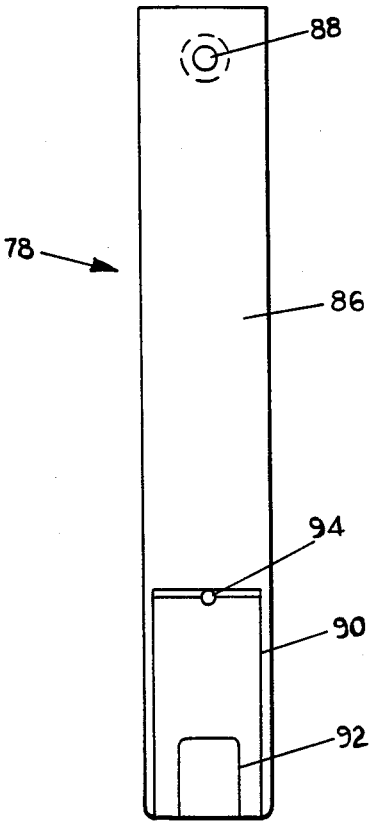
FIG. 9 is a face view of the slide mechanism of the present invention.
Figure 8:
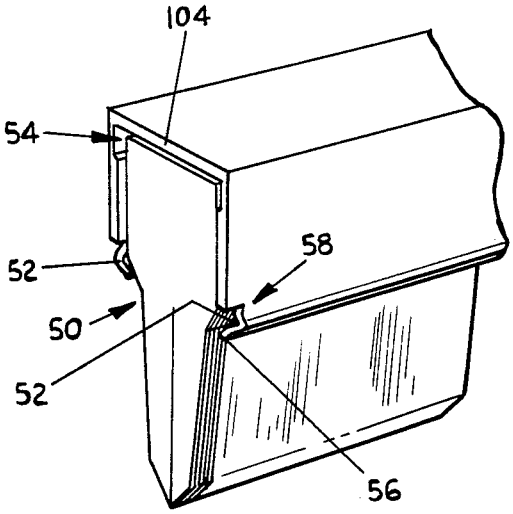
FIG. 8 is a perspective view showing the label storage magazine of the present invention.
Figure 10:
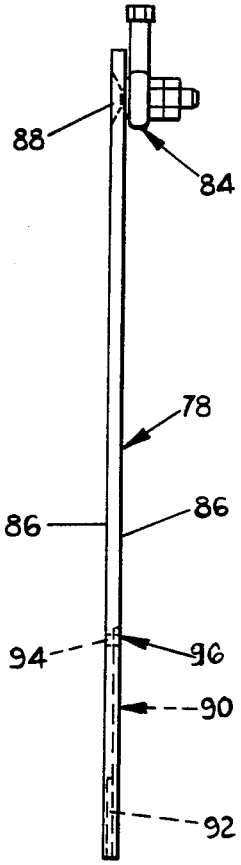
FIG. 10 is a side edge view of the slide member of the present invention.

The details of each label inserting unit are shown in FIGS. 3–7. Labels are stored in a stack in a label storage magazine 46 extending longitudinally along the conveyor table. The label magazine consists of an aluminum extrusion having an open portion 48 in the top thereof for insertion of labels. The labels are inserted in a stack as shown in FIG. 6, with the head portion 18 of the label resting in the extrusion and the stems extending downwardly through an open bottom portion 50 of the extrusion. Notches 52 at the lower corners of the extrusions and notches 54 at the upper corners of the extrusions are recessed in order to provide for room for improperly die-cut labels having ragged edges or corners. A lower edge 56 of the extrusion is beveled inwardly in order to provide shoulders on which the head portion of the identification labels rest. The outer ends of the shoulders are relieved to provide recesses 58 for interfitting gates 102 that permit the outermost label to slide downwardly from the label inserting machine under an appropriate pressure. The labels are urged in the direction of the outermost label (to the left in FIGS. 1 and 3) by means of an air or pneumatic label advance cylinder 60 having an output shaft 62 connected to a triangular floating shoe or head pivotally connected to the end of shaft 62. The air cylinder resiliently urges the labels to the left so that an outermost label is continuously in position to be moved downwardly through the recess 58 at the outermost end of the storage magazine.

Labels are urged downwardly out of the storage magazine by means of a label insertion mechanism 66 mounted transversly to the storage magazine at the outermost end thereof. Insertion mechanism 66 comprises a vertical housing formed of an aluminum extrusion 68 having an open interior. A cover plate 70 is attached by threaded fasteners 72 or the like to the left side (FIG. 1) of the vertical extrusion. A top plate 74 is mounted on the upper end of the extrusion and a pneumatic drive cylinder 76 is mounted on the top of the plate 74.

A slide member 78 is vertically reciprocable in a groove 80 formed between cover plate 70 and flanges 82 on the inner surface of the vertical extrusion. A swivel rod connector 84 connects the upper end of the slide with an output shaft of drive cylinder 76, such that the drive cylinder will drive the slide in an up and down direction from a retracted position to an extended position. The retracted position is shown in FIG. 6, whereas the extended position is shown in FIG. 3.

Figure 11:
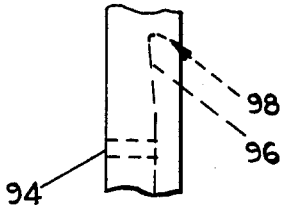
FIG. 11 is an enlarged partial edge view of the slide member of FIG. 10, showing the upper end of the indentation in the slide for the identification label.

Details of construction of slide 78 are shown in FIGS. 9–12. Slide 78 comprises a flat metal plate having a flat face or surface 86 on both sides, with an opening 88 being formed in the upper end thereof for connection with swivel rod connector 84. The front (right side) of the lower end of the slide is provided with an indented or grooved or stepped portion 90 of sufficient size to permit a label 14 to fit within the indented portion. For a label 0.017 inches thick the indentation or groove is about 0.018 inches deep. A further relieved portion 92 can be provided at the lower end of the plate to provide additional space so that the creased portion 20 of the stem of the tag can fit within the relieved portion 92 while the tag is still maintained flat against the slide. A small vacuum hole 94 extends through the slide adjacent the upper end of the recessed portion. As shown in FIG. 11, recess 90 may optionally have deeper portion 96 at the upper end thereof (about 0.020 in the above example) to improve the grip of the upper end of the indentation on the label. The upper end of the indentation or groove forms a ridge or projection 98 above the label that engages the label when the slide is moved downwardly over the outermost label in the stack. Ridge or projection 98 has an upwardly and inwardly extending surface thereon that causes the label to be urged inwardly against the surface of the slide as the slide moves downwardly with the ridge against the top of the label. This separates the outermost label from the other labels and serves to hold the outermost label against the slide.

The manner in which the vacuum hole operates to hold the label to the slide is illustrated in FIG. 6. Cover plate 70 is provided with a vacuum opening 100 adjacent the side of the slide away from the label magazine. The space between the cover plate and the slide forms a vacuum housing. When a vacuum is drawn through inlet 100, this creates a vacuum on the outer (left) side of the slide, and this in turn causes a vacuum to be drawn through vacuum hole 94. The vacuum drawn through hole 94 tends to draw the outermost label into contact with the slide and grips and holds the outermost label against the slide as it moves downwardly from its retracted to its extended position. When the slide proceeds downwardly to the point where the vacuum hole extends out of the vacuum housing, the vacuum is broken and no longer serves to hold the label against the surface of the slide. By this time, however, the lower tip of the label has been inserted in the ground and the tag is at least in the process of being pushed downwardly into the soil in the plant container. When the vacuum has been broken, the slide can be retracted, leaving the label inserted in the plant container.

In order to insure that only one label is inserted in the plant container for each reciprocation of the slide member, a pair of gates 102 are attached to cover plate 70 at each side of the outer ends of the storage magazine extrusion. These gates are positioned immediately adjacent the front surface of the slide and are spaced therefrom a sufficient distance to permit one label and one label only to pass between the gates and the indented surface of the slide.

In order to prevent the slide mechanism from picking up a label and lifting it upwardly as the slide retracts, a stripper bar 104, which can be the front top edge of the storage magazine abuts the front surface of the slide. The stripper bar prevents any label from passing between the slide and the stripper bar and thus prevents any label from being pulled upwardly into the housing for the slide. With the stripper bar and gates of the present invention, the action of the slide is limited to the downward movement of one label at a time through the end of the storage magazine.

As shown in FIG. 3, the label inserting apparatus is positioned above the height of the soil in the plant container a sufficient distance so that the plate extends downwardly just to the soil when it is fully extended. At this point, vacuum hole 94 has just cleared the bottom of the label inserting apparatus and the ridge or indentation above the label also has just cleared the label inserting apparatus. The end of the slide in its extended position may come in contact with the soil in the plant container and pick up dirt or debris on the end of the slide. To prevent this dirt and debris from being drawn into the closely spaced slide groove in the housing for the slide, gas that is exhausted from a valve 126 during the retraction mode is directed to an air cleaning hole 106 in a manifold 107 mounted around the slide at the lower end of the label inserting apparatus. The manifold has interior openings that direct the air in a downward jet against the slide as it retracts, dislodging and removing any dirt picked up by the end of the slide before the slide is retracted into the housing.

The pneumatic arrangements of the present invention are shown in FIG. 1. Pressurized air is received through an air inlet 108 and is conveyed through pressure regulator and water trap 110 (set at 80 to 100 pounds) and pressure regulator and oiler 112 (set at 5 to 10 pounds), with a manifold 114 being positioned between the regulators. A conduit 116 extends from the outlet of regulator 112 to a manually actuated control valve 118, with outlets of the control valve extending through conduits 120 and 122 through opposite ends of the pneumatic label advance cylinder 60.

Conduit 124 extends from manifold 114 to valve 126. The position of this valve is controlled by conduit 128 or 130. The outlets of valve 126 are connected by conduit 132 and 134 to the lower and upper ends, respectively, of drive cylinder 76. A shut off valve 136 lets the operator shut off any unit of the inserting apparatus. Manifold B 137 and 139 direct air to the drive cylinders of each of the three label inserting units shown in FIG. 2. Conduit 138 conveys exhaust gas from one exhaust port 141 of valve 126 to air cleaning inlet 106, such that when the valve shifts and cylinder 76 is retracted, the exhaust gas from the valve acts as the air pressure to clean the dirt and debris from the end of the slide as it retracts.

One means in which the actuation of the label inserting apparatus is timed with the position of the plant container is shown in FIG. 1. In this figure, wherein the planting tray has three columns of plant compartments and six rows of plant compartments, six position sensing pneumatic switches 140A–F each have an actuating member that is tripped by a particular portion of the planting tray, for example the front of the planting tray. As the planting tray trips each switch (in the example it would trip switch 140F first) the switch receives air pressure from conduit 128 and transmits a pneumatic signal through conduit 131 to a one shot valve 129. This in turn actuates valve 126 to energize a slide drive cylinder 76 to insert a label in the plant compartment immediately below the label inserting apparatus. When the next switch 140E is actuated by the front of the tray, the cycle is repeated, and so on.

The same type of result could be accomplished with a single switch that is actuated by contact with each plant compartment or a projection representative of the position of each plant compartment as it passes the switch. Desirably, a special projection can be formed on the plant compartments so that they will contact and actuate the microswitch as they pass. Also (as shown in phantom in FIG. 1) it is possible to use a movable projection 200 under the plant tray that engages the front edge of each plant tray and moves with it dragging a chain 202 with spaced projections 204 indicative of plant compartment position. The projections can actuate a single switch 206.

One of the most important difficulties overcome with the apparatus of the present invention is that very thin pliable plastic labels are effectively retained on the slide and inserted one at a time with good consistency in individual plant compartments of a planting tray and that multiple insertions of labels and instances of machine jamming are minimized.

It should be understood that various modifications and changes may be made in the arrangements and details of construction of the apparatus disclosed herein without departing from the spirit and scope of the present invention, which is defined in the attached claims.

The embodiments of the invention in which an exclusive property or privilege is claimed are defined as follows:

1. Label inserting apparatus for automatically inserting identification labels formed of a flexible non-metallic sheet material into plant containers containing soil comprising:

conveying means for carrying a series of plant containers along a predetermined path;

storage means for holding a plurality of labels in a stack above the path in position to be inserted into the containers as they pass under the labels;

insertion means for inserting labels one at a time into the plant containers by gripping the outermost label on the stack and sliding the label out of the stack and into the plant container as it passes under the labels adjacent the label; and control means for causing a label to be inserted in each plant container as it passes by the insertion means.

2. Label inserting apparatus according to claim 1 wherein:

the storage means comprises a horizontal storage magazine that holds the labels in a horizontal stack, with the magazine restraining downward movement of all labels except the outermost label in the stack, the storage means comprising resilient biasing means urging the labels in a direction toward the outermost label; and the insertion means comprises a reciprocable slide member mounted transversly to the storage magazine for up and down movement between a retracted and an extended position, the slide member having a front surface that abuts the outermost end of the stack of labels, the slide member including gripping means for holding the outermost label to the front surface such that the slide engages and moves the label downward into the plant container as it slides in a downward direction, the insertion means further comprising drive means for reciprocating the slide member.

3. Label inserting apparatus according to claim 2 wherein the gripping means on the slide comprises an outwardly extending portions of the front surface positioned such that it is above the labels when the slide is in its retracted position, the outwardly extending portion extending outwardly only enough to engage the outermost label in the stack when the slide extends downwardly against the end of the stack of labels.

4. Label inserting apparatus according to claim 3 wherein the gripping means further includes vacuum means for urging the outermost label against the front surface of the slide.

5. Label inserting apparatus according to claim 3 wherein the slide is a flat plate member with the front surface of the slide comprising an indented portion into which the outermost label fits when the slide is retracted, the top of the indented portion providing a label engaging ridge that constitutes the outwardly extending portion of the slide.

6. Label inserting apparatus according to claim 5 wherein the ridge is upwardly and inwardly beveled such that the ridge urges the top of the label inwardly against the slide when the slide moves downwardly against the label.

7. Label inserting apparatus according to claim 1 wherein the slide reciprocates vertically in a track in a housing, the portion of the housing on the side of the slide away from the labels being substantially closed and the insertion means comprising means for drawing a vacuum in said portion, the slide having a vacuum opening therethrough at a position opposite the labels when the slide is retracted, the outermost label being drawn against the slide by the drawing of the vacuum through said housing, the portion of the slide having the vacuum opening extending out of the housing when the label is inserted in the plant container so as to break the vacuum and release the label when it is inserted into the plant container.

8. Label inserting apparatus according to claim 1 wherein the apparatus includes gate means adjacent the front surface of the slide for preventing more than the outermost label from being inserted in a plant container at one time, the label inserting means further including upward restraining means for preventing the outermost labels from moving substantially upwardly in contact with the slide as the slide retracts.

9. Label inserting apparatus according to claim 2 and further including air cleaner means for automatically cleaning debris or plant container soil from the lower end of the slide as the slide retracts from its extended position.

10. Label inserting apparatus according to claim 1 wherein the plant containers comprise flats having multiple rows and columns of aligned individual plant cavities, with the label inserting apparatus including a separate label inserting unit for each column and the control means including position sensing means that actuates the label inserting units each time a row of plant cavities is properly positioned below the label inserting units.

11. Label inserting apparatus according to claim 10 wherein the control means comprises a series of limit switch means aligned along the plant container path, each limit switch means being actuated by the passage of a portion of a multiple row plant container so as to cause proper insertion of a label in a particular container row, the successive limit switches causing insertion of labels in the successive rows.

12. Label inserting apparatus according to claim 10 wherein the control means comprises a single switch with an actuating mechanism responsive to the passage of each plant cavity row in the flat, with labels being inserted in a row of plant cavities each time the actuating mechanism is actuated.

* * * * *